US005232269A

United States Patent [19]

Addington et al.

[11] Patent Number: 5,232,269

[45] Date of Patent: * Aug. 3, 1993

[54] LAUNCH VEHICLE FOR CONTINUOUS MINING APPARATUS

[75] Inventors: Larry C. Addington; Robert R. Addington; Larry M. Addington, all of Catlettsburg; Albert E. Lynch, Flatwoods, all of Ky.; John Susla, Charleston, W. Va.; David L. Conley, Ashland, Ky.; John J. Sartaine, Russell, Ky.; David E. Price, Solder, Ky.

[73] Assignee: Mining Technologies, Inc., Ashland, Ky.

[ * ] Notice: The portion of the term of this patent subsequent to May 12, 2009 has been disclaimed.

[21] Appl. No.: 769,408

[22] Filed: Oct. 1, 1991

[51] Int. Cl.[5] ..... E21C 29/00; E21C 35/20

[52] U.S. Cl. ..... 299/67; 198/594; 299/57

[58] Field of Search ..... 299/18, 57, 64, 67; 198/303, 583, 588, 594, 860.2, 861.1

[56] References Cited

U.S. PATENT DOCUMENTS

| | | | |
|---|---|---|---|
| 2,780,451 | 2/1957 | Alspaugh et al. | 299/18 |
| 2,872,170 | 2/1959 | Alspaugh et al. | 299/57 X |
| 3,135,502 | 6/1964 | Muehlman | 299/56 |
| 4,014,574 | 3/1977 | Todd | 299/18 X |
| 4,036,529 | 7/1977 | Hawthorne et al. | 299/57 X |
| 4,953,915 | 9/1990 | Jasser et al. | 299/18 |
| 5,112,111 | 5/1992 | Addington et al. | 299/18 |

*Primary Examiner*—David J. Bagnell
*Attorney, Agent, or Firm*—King and Schickli

[57] ABSTRACT

A launch vehicle is provided for a continuous mining system including modular conveyor units that may be connected together to form a conveyor train. The launch vehicle includes an elongated frame that holds a belt conveyor for conveying aggregate material that is received from the conveyor train. A drive assembly for selectively advancing and withdrawing the conveyor train is also provided on the launch vehicle. Additionally, the launch vehicle includes a mechanism for adding a modular conveyor unit to the conveyor train. More specifically, the conveyor train drive assembly includes a pair of cooperating tandem drive cylinders. Each drive cylinder includes a pusher arm unit that is adapted to engage one of the modular conveyor units of the conveyor train. The conveyor unit adding mechanism includes a positioning mechanism that holds and places a conveyor unit on the launch vehicle. A pusher cylinder is also provided to push the new conveyor unit into engagement with the rear of the conveyor train. The launch vehicle also includes an extensible front end.

23 Claims, 5 Drawing Sheets

LAUNCH VEHICLE FOR CONTINUOUS MINING APPARATUS

TECHNICAL FIELD

The present invention relates generally to the art of mining and, more particularly to a launch vehicle for an apparatus adapted for the continuous mining of aggregate material, such as coal, in situ.

BACKGROUND OF THE INVENTION

Coal, formed from decomposed and compressed vegetable matter, is typically found in substantially horizontal seams extending between sedimentary rock strata such as limestone, sandstone or shale. Surface and underground mining are the primary techniques used to recover this coal.

Surface or strip mining involves the removal of material, known as overburden, overlying a coal seam so as to expose the coal for recovery. In recent years, surface mining has gained prominence over underground mining in the United States. This is due to many factors including:

(a) the increased material moving capacity of surface or strip mining equipment;

(b) lower costs for surface mining than underground mining;

(c) the better safety record of surface mining versus underground mining;

(d) the higher coal recovery percentage for extraction of many coal reserves by surface mining.

Surface mining does, however, have its limitations despite these cited advantages. The primary limiting factor relates to the depth of the overburden. Once the coal seam reaches a certain depth below the surface, the amount of overburden that must be removed to reach the coal simply makes strip mining economically unfeasible.

When this occurs, large quantities of coal may still remain in the ground. If economic recovery of this coal is to be achieved, other mining methods must be utilized. Underground mining application in such an instance is, typically, very limited. This may be due to a number of factors including the existence of poor roof support conditions, the thinness of the seam and/or the presence of insufficient quantities of coal to warrant the large capital investments characteristic of underground operations.

Due to these considerations, auger mining is often used to recover coal following a strip mining operation where the overburden becomes too costly to remove. A large auger is used to bore into the face of the seam and recover the coal from beneath the overburden. Advantageously, auger mining is very efficient providing more tons per man per day than any other form of state of the art mining techniques. Auger mining may also be initiated quickly and requires a relatively low capital expenditure when compared to surface and underground mining. Auger mining has also been found to date to be the best method to use in relatively thin seams. Further, auger mining is safer than both surface and underground mining. Thus, auger mining may be used to effectively supplement a strip mining operation and recover small coal deposits that would otherwise be left behind.

Auger mining is, however, also not without its disadvantages. Auger mining provides a relatively low total coal recovery. Coal recovery for the resource area being augured is usually less than about 35%. Some of the lost recovery is due to the pillars of coal that are left standing to support the overburden between adjacent auger holes. The majority of the recovery shortfall, however, is due to the limited penetration depths achievable with even state of the art auger mining equipment.

More particularly, as penetration depths increase, a greater number of auger flights are required to convey the coal from the cutting head to the seam face for recovery. Each flight adds to the frictional resistance to the turning of the auger through contact with the walls of the bore hole. Additionally, the longer the string of auger flights, the greater the weight of coal being moved by the flights at any one time. As a result, it should be appreciated that auger power requirements increase rapidly with the depth of auger penetration.

Due to the above considerations, holes drilled by conventional auguring equipment are usually only of a depth of 150 feet with 200 feet being rarely attainable. Of course, any increase in this figure is desirable as it would greatly improve the coal recovery rate from a resource area.

A mining system and method has been recently developed to meet this end. More particularly, this system and method is disclosed in U.S. Pat. No. 5,112,111, issued May 12, 1992, entitled APPARATUS AND METHOD FOR CONTINUOUS MINING and assigned to the assignee of the present invention. The full disclosure made in that patent application is incorporated herein by reference.

As best shown in FIG. 1, the mining system includes a continuous miner for cutting coal from a coal seam. The cut coal is fed by the miner to a conveyor train comprised of a series of modular conveyor units serially connected end-to-end. This system allows mining to depths far exceeding the 150 to 200 feet possible with conventional auger mining equipment. In fact, depths of over 1300 feet have been reached.

Each conveyor unit is supported on ground engaging wheels so as to be adapted to follow the miner as the miner advances into the coal seam. A launch vehicle 10 is also incorporated into this new system. The launch vehicle includes a conveyor mechanism for receiving and conveying aggregate coal discharged by the conveyor train. The launch vehicle also includes a guide track for supporting the end unit of the conveyor train and a conveyor unit to be added to the train. Further, individual drive assemblies are provided for (1) advancing/withdrawing the conveyor train with the miner and for (2) pushing the new conveyor unit into engagement with the conveyor train. Advantageously, the system allows the aggregate coal to be cut and conveyed without interruption even when a conveyor unit is being added to the train. Hence, the system not only provides significantly improved recovery from the resource area but also operates more efficiently than auguring equipment and provides improved productivity. The present invention relates to a launch vehicle for this type of mining system.

SUMMARY OF THE INVENTION

Accordingly, it is a primary object of the present invention to provide a launch vehicle for a mining system including a continuous miner that feeds aggregate material to a conveyor train comprising a number of modular conveyor units serially connected together.

Another object of the present invention is to provide a launch vehicle for a mining system that is specifically adapted to allow the cutting and conveying of aggregate material to a delivery location even as a modular conveyor unit is being added to the conveyor train. This serves to enhance the operating efficiency of the mining system and significantly improve productivity.

Yet another object of the present invention is to provide a launch vehicle including (1) a conveyor for receiving aggregate material from a conveyor train; (2) a mechanism for aiding in advancing and withdrawing the conveyor train into and from a coal seam face behind a continuous miner; and (3) a separate mechanism for adding the conveyor unit to the conveyor train as coal is being conveyed to a delivery location.

Still another object is the provision of a launch vehicle of shorter overall length so as to be more maneuverable when transporting to and operatively positioning at a mining site. This is achieved by providing the launch vehicle with an extensible front end that may be retracted during transport.

Additional objects, advantages and other novel features of the present invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects and in accordance with the purposes of the present invention as described herein, an improved launch vehicle is provided for a continuous mining system including modular conveyor units that may be connected together to form a conveyor train. The launch vehicle includes a main frame that holds a conveyor for receiving aggregate material from the conveyor train. A drive mechanism is also provided on the main frame for selectively advancing and withdrawing the conveyor train. Additionally, an independent system is provided for adding a modular conveyor unit to the conveyor train. Advantageously, due to the structural arrangement of the launch vehicle as described in greater detail below, a modular conveyor unit may be added to the conveyor train as the mining system continues to operate cutting and conveying aggregate material. Thus, "real" continuous mining is provided.

More specifically, the drive assembly for selectively advancing and withdrawing the conveyor train includes a pair of cooperating tandem drive cylinder sets; one tandem drive cylinder set being mounted to the main frame longitudinally aligned with and spaced from the other. The tandem cylinders of each set are mounted to the main frame on opposing sides of the launch vehicle conveyor. Thus, each tandem cylinder set has a left side and a right side cylinder. Both of the tandem cylinders of the forward set operate together as do both of the rearward cylinders.

The ends of each cylinder include a lever arm pusher unit for engaging a pin on a modular conveyor unit of the conveyor train. The pusher unit includes a body and a substantially V-shaped arm pivotally mounted to the body. The pusher arm is selectively positionable in one of two opposing operative positions. In one position, the arm engages the pin of a modular conveyor unit in a manner to allow the drive assembly to advance the conveyor train. In the other position the arm engages the pin of the modular conveyor unit so as to allow the drive assembly to aid in the withdrawing of the conveyor train from the coal face. In either operative position one end of the pusher arm engages the body to hold the arm in position.

The forward and rearward drive cylinder sets are operated in a counter reciprocating manner. More specifically, when the pusher arm units of the rearward cylinders are engaging a pair of pins on each side of a modular conveyor unit of the conveyor train, the rearward cylinders are actuated to advance (or withdraw) the conveyor unit/train into (or from) the seam. As this occurs, the forward cylinders are recycled. When the rearward cylinders reach the end of their stroke, the pusher arm units of the forward cylinders are in position to engage a pin on each side of a modular conveyor unit of the conveyor train. The forward cylinders are then actuated to further advance (or withdraw) the conveyor train while the rearward cylinders are recycled. This method of advancing or withdrawing the conveyor train by the above-described shuttling operation of the tandem cylinder sets is repeated as necessary to provide for the continuous operation of the mining system as is described in more detail below.

The assembly for adding a modular conveyor unit to the conveyor train includes a mechanism for positioning the conveyor unit to be added on the launch vehicle behind the conveyor train. The positioning mechanism may include a winch arrangement mounted to the overhead canopy of the launch vehicle. More particularly, the winch arrangement may include a single power source or drive motor connected via a power output transmission to a pair of take-up reels. One take-up reel is mounted to the canopy of the launch vehicle near the operator cab. The other take-up reel is mounted to the canopy of the launch vehicle forward of the first one approximately the length of a conveyor unit. Each take-up reel includes a line having a proximal end connected to the reel so as to allow paying out or taking-up as desired. The distal end of each line is attached by means of a sling to a cross bar and hook arrangement. These hooks are adapted to engage and hold a conveyor unit.

In operation, the lines are taken-up on the reels to a raised position. A modular conveyor unit is then placed between the cross bars at the ends of the lines by a front end loader. Next, the hooks are attached to the pins at the two ends of the conveyor unit which is then suspended on the winch lines as the front end loader is disengaged and backed away. The conveyor unit is held by the lines overlying the conveyor train until the train is advanced sufficiently into the seam to provide clearance for the positioning of the new modular conveyor unit onto the launch vehicle floor. During this time, the power and control lines of the conveyor unit being added to the train are coupled to the end unit of the train. This coupling initiates operation of the belt conveyor of the new conveyor unit. Once sufficient clearance exists the winch lines are payed out until the modular conveyor unit held in the hooks rests on the launch vehicle platform. The hooks are then released from the pins on the conveyor unit and the lines taken-up back to the original position. The cross bars and hooks are then in position to receive from the front end loader the next modular conveyor unit that is to be added to the conveyor train.

Once the new conveyor unit is positioned on the launch vehicle behind the conveyor train, a pushing mechanism is actuated. More specifically, a pusher cylinder is positioned on the launch vehicle behind the conveyor unit underneath the operator cab. A bumper on the forward end of the piston rod of this pusher cylinder engages the back of the conveyor unit. Thus, as the rod is extended from the cylinder, the conveyor unit is advanced into engagement with the rear of the conveyor train. Pins are then positioned in cooperating couplings to connect the new modular conveyor unit to the conveyor unit at the end of the conveyor train. Once the coupling is completed, the pusher cylinder of the pushing mechanism is recycled to the retracted, starting position. The above-described steps are repeated as required to add additional conveyor units to the train.

In order to allow the effective application of force to the conveyor train by the drive assembly of the launch vehicle as it aids in advancing (or withdrawing) the train, it is important that the launch vehicle be anchored to the ground. Any appropriate anchoring mechanism may be provided including stakes driven into the ground to which the launch vehicle is rigidly attached.

The launch vehicle also includes a support and guide mechanism in the form of a guide track adapted to maintain the modular conveyor units on the launch vehicle frame straddling the aggregate material conveyor. More specifically, the tracks may take the form of a pair of spaced floor grate sections adapted to support the ground engaging wheels of the modular conveyor units. A pair of guide rails adjacent and outside the sides of the aggregate conveyor extend upwardly from the floor grate sections toward the inner surfaces of the ground engaging wheels. Should a conveyor unit be slightly out of alignment these rails engage the inner surfaces of the wheels to realign the unit of the conveyor train as necessary. Thus, proper alignment is insured. Of course, by maintaining the end of the conveyor train overlying the launch vehicle conveyor, aggregate material from the conveyor train is received and conveyed by the launch vehicle conveyor even as a modular conveyor unit is being added to the train.

More particularly, aggregate material from the last unit of the conveyor train is received directly by the launch vehicle conveyor until such time as it is intercepted by the conveyor on the modular unit being added to the train. In accordance with the present invention, the conveyor on the newly added modular unit is already operating at the time of interception. Thus, the intercepted aggregate material is advanced by the conveyor of the newly added modular unit until it is once again discharged onto the conveyor of the launch vehicle. The conveyor of the launch vehicle then conveys the aggregate material to a discharge conveyor. The discharge conveyor conveys the material to a delivery location such as a stockpile or bed of a truck that hauls the coal to another site. Accordingly, it should be appreciated that the present invention allows the conveyance of aggregate material even during the time that the conveyor train is being lengthened by the addition of another modular unit.

It should also be appreciated that the launch vehicle includes a mechanism allowing it to be advanced across the bench to a new mining site. More specifically, the launch vehicle may include a lift system that lifts the launch vehicle frame above the ground so that the frame is solely supported on two skids spaced along the base of the frame. Heavy equipment such as a bulldozer may then be used to push the launch vehicle on the skids to the new mining location. Alternatively, auger skids of a type known in the art may be utilized to move the launch vehicle to the next mining location. Once the launch vehicle is properly positioned for mining at the new location, the lift mechanism may again be activated to lower the frame into engagement with the ground. The lowering of the frame not only positions the guide tracks at the proper height for support of the modular conveyor units but also serves to further anchor the machine so as to hold its position when the drive mechanism is activated to aid in the advance/withdrawal of the conveyor train.

In order to allow operation of the mining system on a narrower bench and to make it easier to transport the launch vehicle from one mine location to another, the launch vehicle may also be equipped with an extensible front end. More particularly, the launch vehicle many include an extensible framework having a series of track members adapted to support the mining machine or conveyor units of the conveyor train. The track members are received in sliding, interdigitating engagement with a second series of cooperating track members held stationary on the main frame. A pair of actuator cylinders are connected to the extensible framework. These actuator cylinders are adapted to displace the framework between two operative positions.

In the first operative position, the extensible framework is retracted so that the first series of track members are received between the second series of track members on the main frame. Thus, the overall length of the launch vehicle is shortened to aid in transportation to and placement at the mining site. In the second operative position, the extensible framework is extended so that the first series of track members extend outwardly from the second series (e.g. even beneath the highwall face on narrow benches as shown in FIG. 1). The extended track members of the first series serve as a stable base or floor to support the conveyor units of the conveyor train. This is a particularly important concern in the area of the highwall face where water tends to collect, significantly softening floor conditions. When withdrawing a conveyor train from underground, the space between each of the first and second series of track members also advantageously serves to provide a waste area where dirt and debris may fall from the conveyor units before the conveyor units are actually positioned upon the main frame of the launch vehicle.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated and forming a part of this specification illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
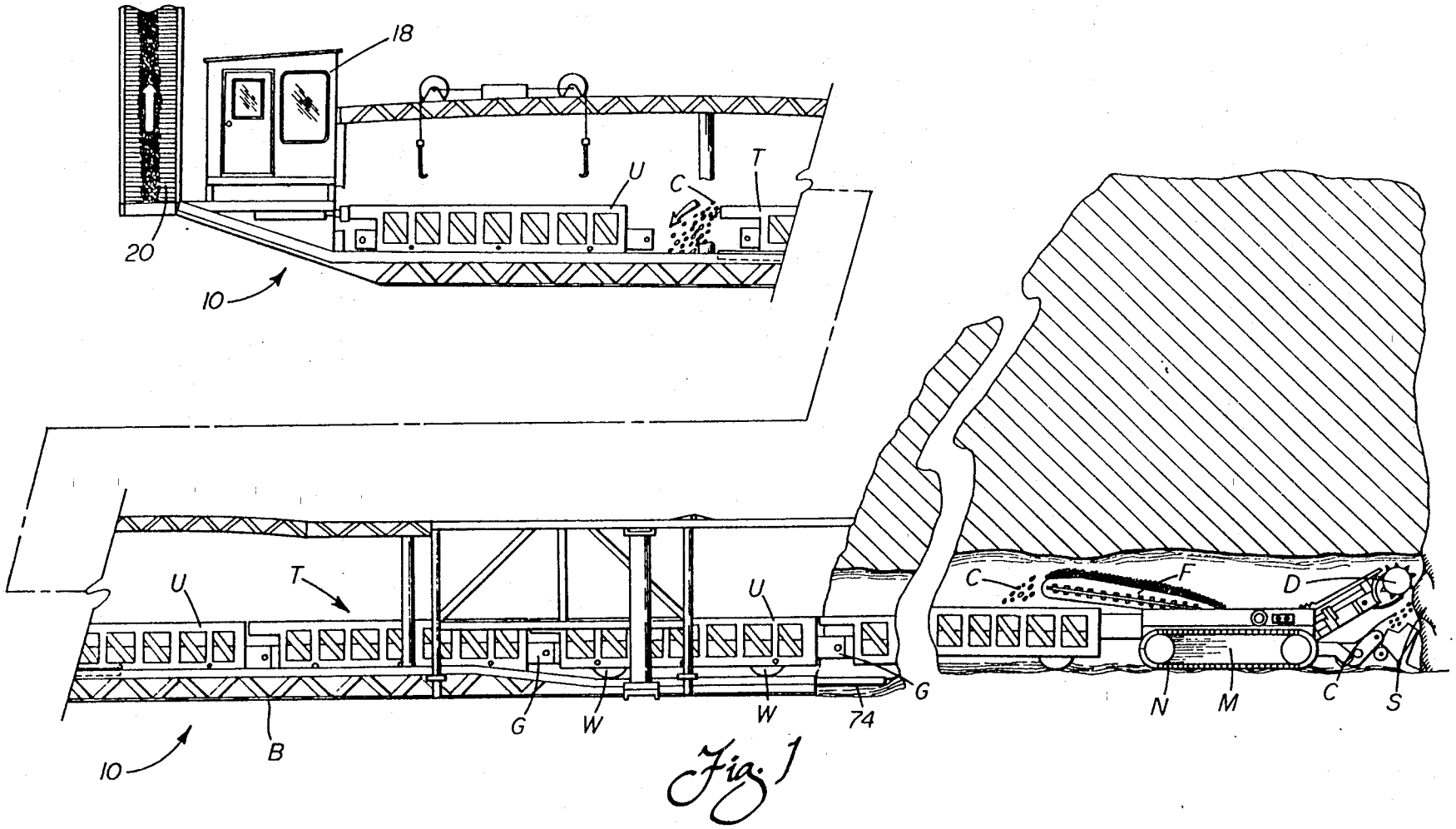
FIG. 1 is a schematical view showing the mining system in which the launch vehicle of the present invention is integrated.
Figure 2A:
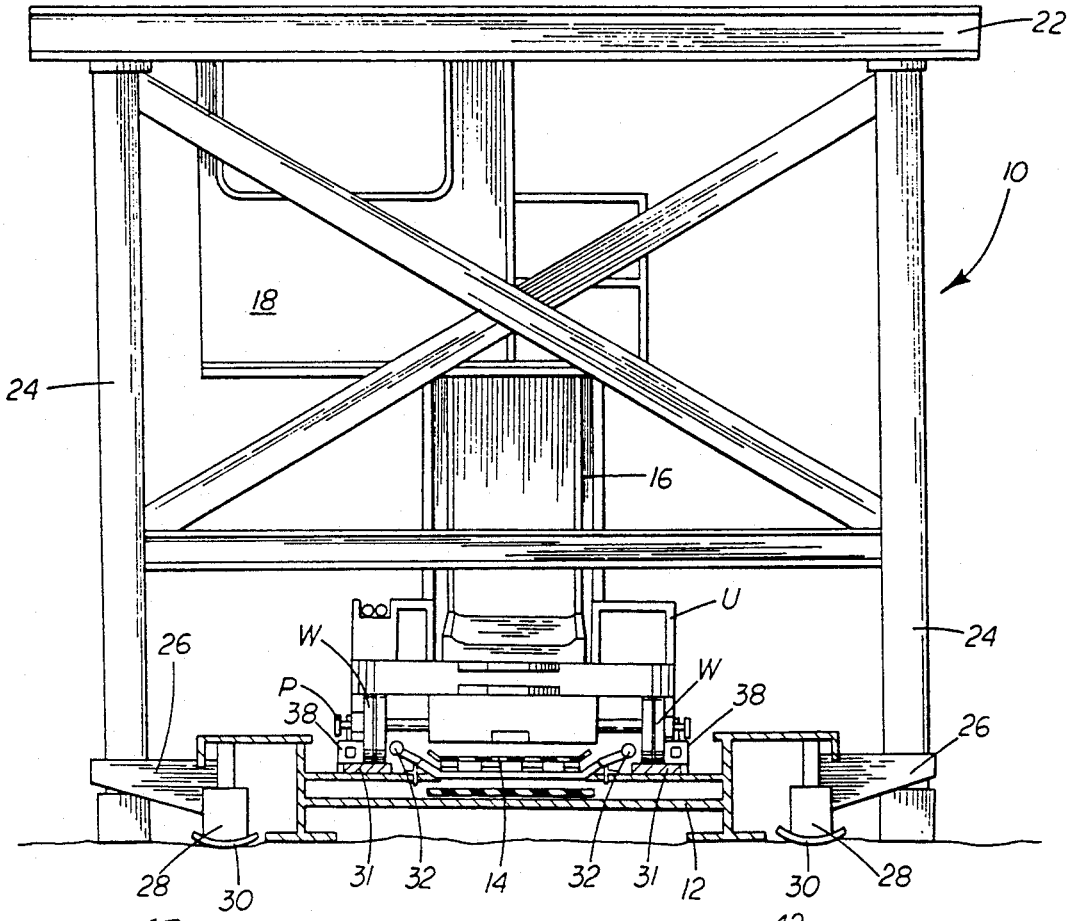
FIG. 2*a* is a partially sectional schematic view showing a modular conveyor unit resting on the frame of the launch vehicle.
Figure 3B:
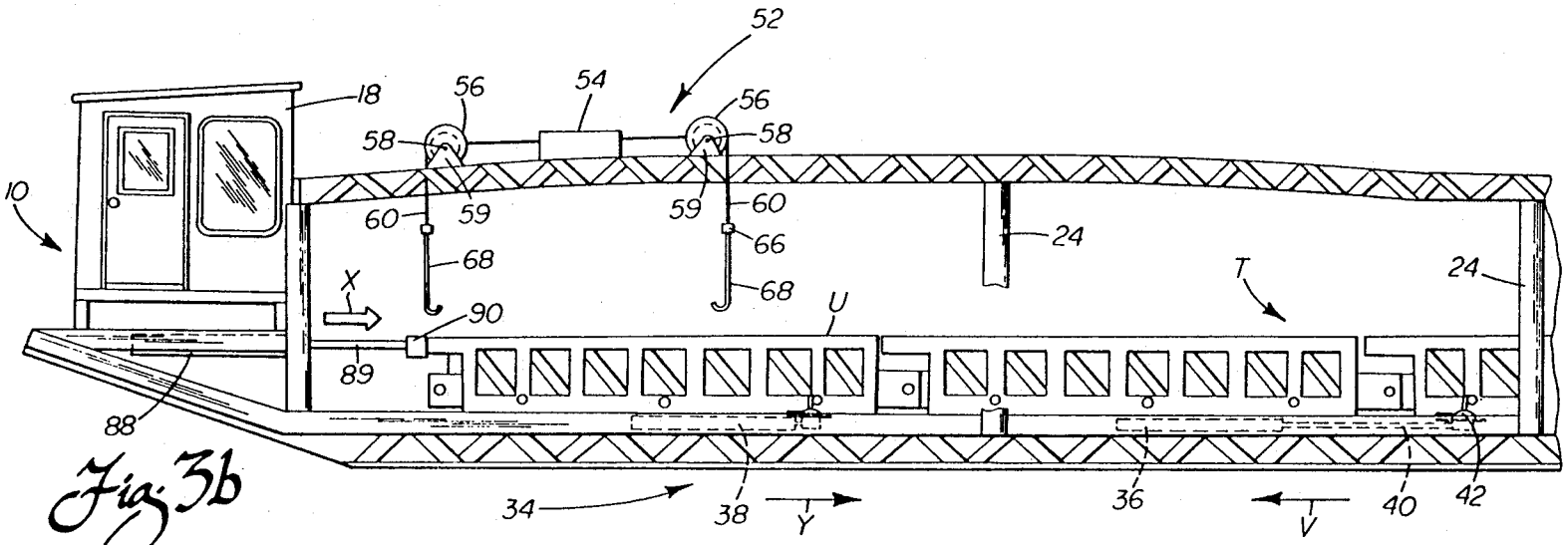
FIGS. 3*a* and 3*b* are schematical side elevational views adapted to illustrate the advancing of the conveyor train by the shuttling action of the pair of cooperating tandem drive cylinder sets as well as the addition of a modular conveyor unit to the train.
Figure 3A:
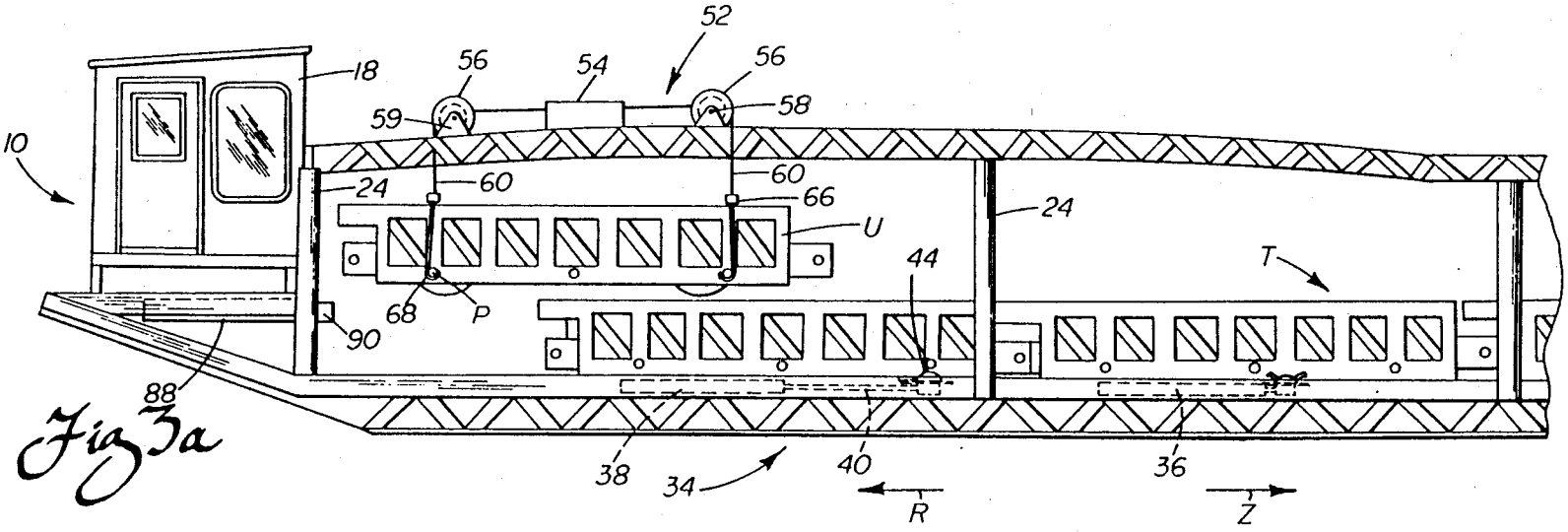

Reference is now made to FIGS. 2*a*, 3*a* and 3*b* schematically showing the launch vehicle 10 of the present invention. As indicated above with reference to FIG. 1, the launch vehicle 10 is adapted for utilization with a continuous mining system including a continuous mining machine M of a type known in the art. The mining machine M includes a rotating cutter head drum D supporting a series of cutting bits on helical flights (not shown). The cutter head drum D is rotatably mounted on a vertically moveable boom that is pivotally mounted on the main frame member of the mining machine M. As also shown, the mining machine is supported for movement along the floor of the mine by a pair of crawler assemblies N.

In operation, the mining machine M is preferably advanced into the seam face S with the boom raised and the cutter head drum D rotating. As the cutting begins at the top level or roof line of the seam, the mining machine M is advanced further forward and the boom is gradually lowered. As the mining machine M is advanced and the boom is raised and lowered, coal C is cut from the seam face S. The aggregate coal C is then collected by means of a conventional gathering head that serves to deliver the aggregate coal to a flight conveyor F.

As shown in FIG. 1, the flight conveyor F delivers the aggregate coal C to the lead conveyor unit of a conveyor train generally designated by reference letter T. The conveyor train also includes a series of modular conveyor units U identical to one another that are releasably coupled together in series behind the lead conveyor unit.

As best described in copending U.S. Pat. No. 5,112,111, issued May 12, 1992, entitled APPARATUS AND METHOD FOR CONTINUOUS MINING and assigned to the Assignee of the present invention (the full disclosure of which is incorporated herein by reference), each of the conveyor units U includes a main structural frame supported for movement on the ground by a series of wheels W. Each conveyor unit U also includes a centrally disposed, longitudinally extending inclined conveyor. The conveyor, which is preferably of the belt type, operates to convey aggregate coal C received at the low end to the high end where it is discharged from one conveyor unit to the next conveyor unit in the series. Each conveyor unit also includes its own motor for driving the belt conveyor held therein. The units U of the conveyor train T are also interconnected by means of control lines that are first routed from a power source such as a generator (not shown) on the bench to the mining machine M and back through the individual conveyor units U. Accordingly, the motors of the conveyor units are connected in series for simultaneous operation at a substantially consistent speed.

Each of the conveyor units U also includes a coupling mechanism G specifically adapted to allow the units to be coupled together in a rigid manner so that the units of the train T remain in completely straight alignment behind the mining machine M. Such a coupling mechanism may, for example, include cooperating clevises on each conveyor unit that are received together in an interdigitating manner and connected by means of a pin.

As should be appreciated from viewing FIG. 1, the conveyor train T includes as many conveyor units U as are necessary to have the train extend out of the seam to the launch vehicle 10 on the bench B. As shown, preferably the bench is undercut below the bottom of the seam so as to receive the launch vehicle or platform 10.

As best shown in FIGS. 2*a*, 3*a* and 3*b*, the launch vehicle 10 includes a main structural framework 12 that supports an aggregate material conveyor 14, preferably of the belt type. This conveyor 14 receives the aggregate coal C from the last conveyor unit U of the train T. The coal C is then delivered by the aggregate material conveyor 14 up an incline 16, beneath the operator control cab 18, to a discharge conveyor 20. The discharge conveyor 20 is also inclined and may, for example, be utilized to convey the aggregate coal C to a delivery location such as the bed of a truck which is used to haul the coal away for stockpiling or further processing.

As also shown in FIGS. 2*a*, 3*a*, and 3*b*, the launch vehicle 10 includes a safety canopy 22. The safety canopy 22 is connected to the main structural framework 12 by a series of spaced support posts 24 and braces 26. Two series of jacks 28 are provided spaced along the length of the launch vehicle 10. The jacks 28 are supported on skids 30 and may be actuated to lift the main framework 12 of the launch vehicle 10 from the bench B so as to allow movement of the launch vehicle by heavy equipment or by auger skids to a mining location as described in greater detail below.

As also shown in FIG. 2*a*, the launch vehicle 10 includes a pair of spaced guide tracks 31 in the form of spaced floor grate sections that are adapted to support the ground engaging wheels W of the modular conveyor units U. Additionally, a pair of guide rails 32 are provided adjacent and outside the sides of the aggregate conveyor 14. These guide rails 32 extend upwardly above the floor grate sections 31 and outwardly from the aggregate material conveyor 14 toward the inner surfaces of the ground engaging wheels W of the conveyor units U. In the event a conveyor unit U is positioned on the launch vehicle 10 slightly out of alignment with the aggregate material conveyor 14, the inner surfaces of the wheels will engage the rails 32 thereby realigning the modular conveyor unit U with the conveyor train T as necessary to insure proper alignment. Advantageously, by maintaining proper alignment of the end unit of the conveyor train T so that it overlies the launch vehicle conveyor 14, aggregate material from the conveyor train is received and conveyed by the launch vehicle conveyor at all times of operation.

As best shown in FIGS. 3*a* and 3*b*, the launch vehicle 10 also includes a drive assembly, generally designated by reference numeral 34. The drive assembly 34 is specifically adapted for selectively aiding in the advancement or withdrawal of the conveyor train T. More specifically, the drive assembly 34 includes a pair of cooperating tandem drive cylinder sets 36, 38. Only one drive cylinder of each set 36, 38 is shown in FIGS. 3*a* and 3*b* as the tandem cylinders of each set are mounted to the main framework 12 on opposing sides of the launch vehicle conveyor 14 (see also FIG. 2*a*). As shown, the forward tandem drive cylinder set 36 is mounted longitudinally aligned with and spaced from the rearward drive cylinder set 38. Further, as also made clear from viewing FIG. 2*a*, each tandem cylinder set 36, 38 has a left side and right side cylinder. Both of the tandem cylinders of the forward set 36 operate together. Similarly, both of the tandem cylinders of the rearward set 38 operate together.

Figure 2B:
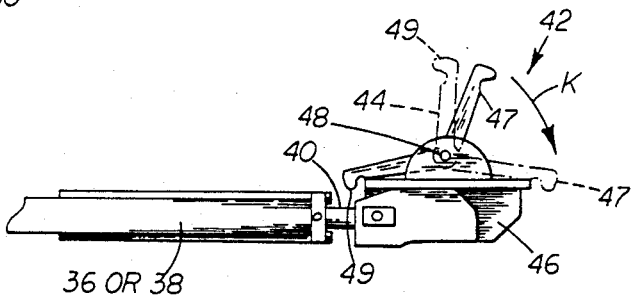
FIG. 2*b* is a partially broken away, detailed side elevational view of the pusher arm unit adapted to operatively connect one of the reciprocating drive cylinders to an individual conveyor unit.
Figure 2C:
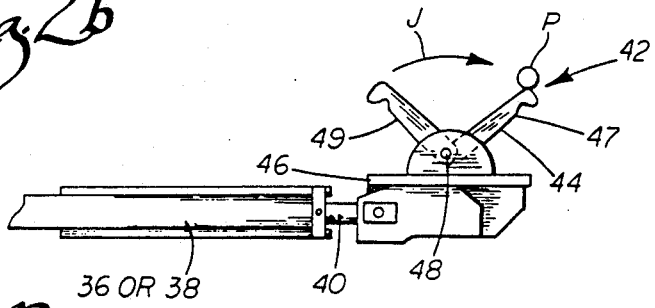
FIG. 2*c* is a detailed side elevational, schematical view of the pusher arm unit showing the pusher arm pivoted down and passing under a pin on a conveyor unit.

Each drive cylinder of sets 36, 38 includes an extensible cylinder rod 40. A pusher arm unit 42 is mounted to a distal end of each cylinder rod 40. As best shown in FIGS. 2*b* and 2*c*, each pusher arm unit 42 includes a substantially V-shaped pusher arm 44 pivotally mounted to a base 46 by means of a pivot pin 48. As described in greater detail below, the pusher arm 44 may be selectively positioned in a first position (shown in full line in FIG. 2*b*) for engaging a cooperating pin P on a conveyor unit U and advancing the conveyor train T into the coal seam S. Alternatively, the pusher arm 44 may be selectively positioned in a second, opposite position (shown in phantom line in FIG. 2*b*) for also engaging a cooperating pin P and withdrawing the conveyor train T from the coal seam S.

Advantageously, the drive assembly 34 is sufficiently powerful to aid in advancing (withdrawing) the conveyor train T and mining machine M into (from) the seam face F. This is a particularly important advantage to the present system as in many mining areas soft bottom conditions, such as fire clay, exist. The crawler assemblies N on a conventional mining machine M tend to dig ruts in the soft bottom until the main frame of the mining machine "high centers" and comes to rest on the undisturbed bottom material between the ruts. Accordingly, continuous mining machines M have a propensity to become stuck where soft bottom conditions are present. As such, mining of these types of seams was often avoided in the past. In contrast, with the present system, mining of these seams is now possible. Thus, the present apparatus effectively opens new areas for mining thereby increasing recoverable coal reserves.

In order to insure that the launch vehicle 10 remains stationary as the drive assembly 34 is operated to aid in the advancement or withdrawal of the conveyor train T and continuous miner M, the launch vehicle may be anchored to the bench B. This may be achieved in any manner known in the art. One approach is to drill a series of holes down into the bench B. Steel pipes up to six inches in diameter may then be extended down into the holes and a taut steel cable may then be attached between each pipe and the launch vehicle 10. Together, the cables and pipes serve to effectively hold the launch vehicle 10 in position during operation of the drive assembly 34.

The launch vehicle 10 of the present invention also includes a mechanism for adding individual modular conveyor units U to the conveyor train T as it is advanced into the coal seam. The mechanism for adding a modular conveyor unit is generally designated by reference numeral 52 and best shown in FIGS. 3*a*, 3*b* and 5. As best shown schematically in FIG. 5, the conveyor unit adding mechanism 52 includes a power source or drive motor 54 connected via a power output transmission (not shown) to a pair of take-up reels 56. Each take-up reel 56 is rotatably mounted upon a shaft 58 held in a cradle 59 mounted to the overlying canopy 22. One take-up reel 56 is mounted adjacent the operator cab 18. The other take-up reel 56 is mounted forward of the first one approximately the length of a conveyor unit (e.g. 45 feet).

A line or heavy duty cable 60 is mounted to each take-up reel 56. More particularly, the proximal end of each line 60 is attached to the associated take-up reel 56 so that rotation of the reel pays out or takes-up the line. The distal end of each line 60 is attached by means of a yoke 62 to a sling 64 that holds a cross bar 66. A pair of downwardly extending hooks 68 are attached to the cross bar 66 at each end. The hooks 68 are adapted to engage the pins P at the ends of a conveyor unit U to be suspended by the winch lines 60. Of course, any other appropriate arrangement could be utilized that is adapted for connecting the winch lines 60 to a conveyor unit U.

Figures 4A, 4B:
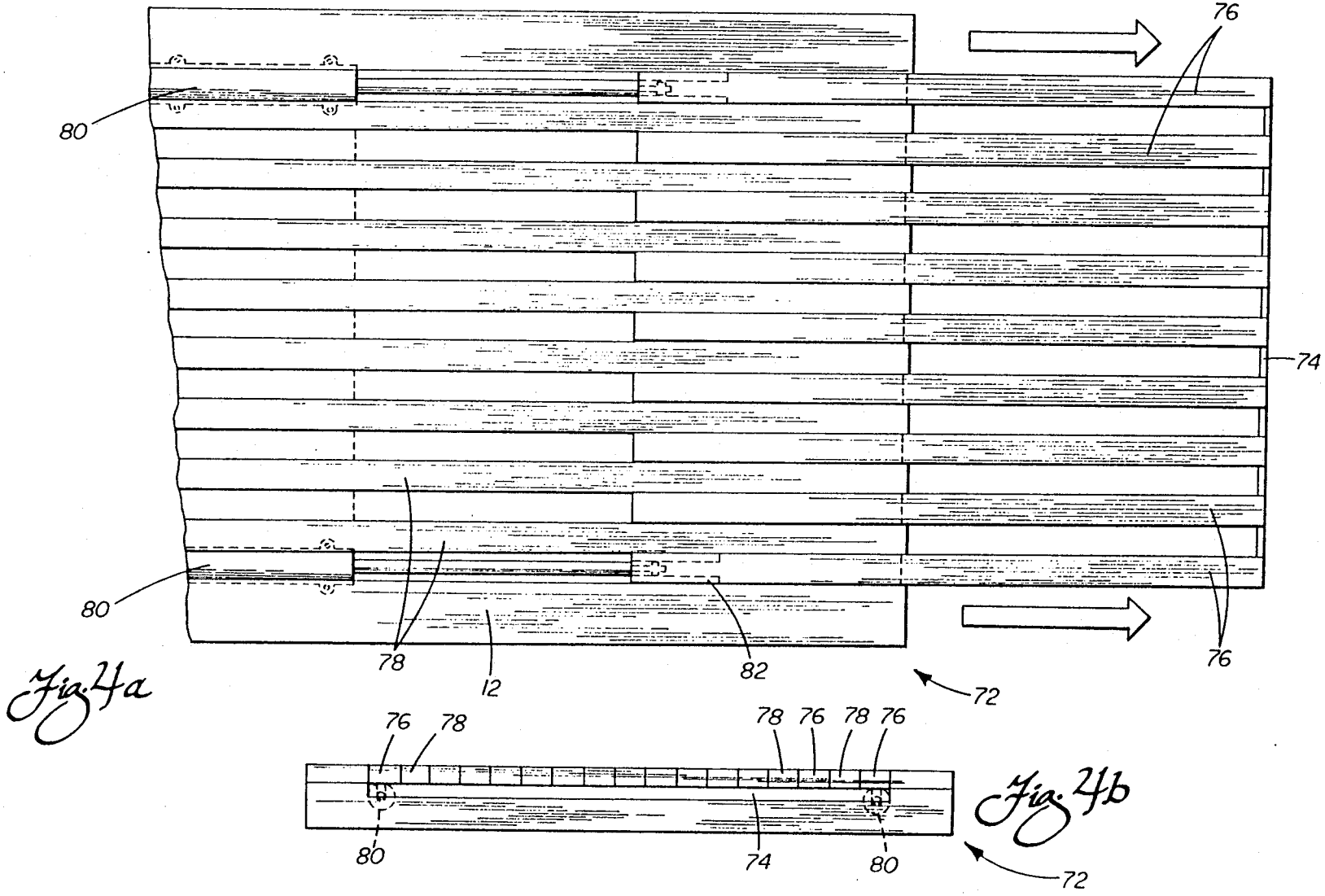
FIG. 4*a* is a top plan view of the extensible front of the launch vehicle.
FIG. 4*b* is a detailed front end view of the extensible front shown in FIG. 4*a;*

Additionally, the launch vehicle 10 may be equipped with an extensible front end generally designated by reference numeral 72 and shown in FIGS. 1, 4*a* and 4*b*. Advantageously, the extensible front end 72 allows the launch vehicle 10 to be positioned for operation even on relatively narrow benches B. Additionally, when fully retracted, it should be appreciated that the launch vehicle 10 is significantly shorter in length thereby making it easier to transport the launch vehicle from one mine location to another. Further, the reduced length makes it easier to move the launch vehicle 10 along the bench B by means of heavy equipment such as a bulldozer from one mining position to the next.

As best shown in FIG. 4*a*, the extensible front end 72 includes an extensible framework 74 having a series of track members 76 adapted to support the mining machine M or conveyor units U of the conveyor train T. The track members 76 are each received in sliding, interdigitating engagement with a second series of cooperating track members 78 held stationary on the mainframe 12. A pair of actuator cylinders 80 are connected to the extensible framework 74 by means of yokes 82. These actuator cylinders 80 are adapted to displace the extensible framework 74 between two operative positions.

In the first operative position, the extensible framework 74 is retracted so that the first series of track members 76 are received between the second series of track members 78 on the mainframe 12. Thus, the overall length of the launch vehicle is shortened. In the second operative position, shown in full line in FIG. 4*a*, the extensible framework 74 is extended so that the first series of track members 76 extend outwardly from the second series 78. The extended track members 78 serve as a stable base or floor to support the conveyor units U of the conveyor train.

As shown in FIG. 1, it is even possible to extend the extensible framework 74 and track members 76 beneath the highwall face. This is an area of the mine floor where water often collects significantly softening the floor conditions. Over time, such softened conditions could lead to conveyor units U settling down and becoming mired in the bottom material. This is a particularly troublesome problem where fire clay conditions exist. Advantageously, by incorporating the extensible front end and utilizing it as a support structure for the conveyor units in the area adjacent the highwall face, this problem is significantly reduced and in most instances avoided.

Operation of the preferred embodiment of the present invention will now be described in detail. Following the completion of surface mining, the bench B is prepared with a bulldozer and/or other heavy equipment by undercutting below the bottom of the seam floor a sufficient distance for the proper positioning of the launch vehicle 10, if possible. The launch vehicle 10 is then transported to the mining site and positioned on the bench B. During transport, the extensible front end 72 is fully retracted so as to reduce the length of the launch vehicle as much as possible for ease in handling.

Next, the launch vehicle 10 is moved directly into position for mining by means of heavy equipment such as a bulldozer. During this operation, the launch vehicle 10 is raised on the jacks 28 so as to be resting on the skids 30 with the framework 12 raised from contact with the bench B.

Once the launch vehicle 10 is properly positioned for mining, the jacks 28 are retracted until the main structural framework 12 rests securely on the bench B. If desired, the extensible framework 74 may then be extended so that the first series of tracks 76 extend, for example, underneath the highwall as shown in FIG. 1. There, the tracks 76 provide a firm, stable base or floor to support the mining machine M and conveyor units U of the train T as they advance underground into the seam.

In order to insure that the launch vehicle 10 remains stationary as the drive assembly 34 is operated to aid in the advance of the conveyor train T and continuous miner M, the launch vehicle may also be anchored to the bench B. This may be achieved in any manner known in the art. One approach is to drill a series of holes down into the bench. Steel pipes (not shown) may then be extended down into the holes and a taut steel cable (not shown) is then attached between each pipe and the launch vehicle 10. Together, the cables and pipes serve to effectively hold the launch vehicle in position during operation of the drive assembly 34.

The mining machine M and the lead conveyor unit U of the conveyor train are preferably positioned on the launch vehicle 10 prior to moving the launch vehicle into position on the bench B. With the crawler assemblies N of the mining machine M aligned with and resting in the guide tracks 31, the boom of the mining machine is raised to align the cutter head drum D with the top of the seam. The cutter head drum D, gathering head and flight conveyor F of the mining machine M are all then activated. Next, the crawler assemblies N are engaged to advance the mining machine M toward the face and into the seam. The mining machine M is operated in a manner known in the art from the operator cab 18 to win aggregate coal C from the seam face S. As the mining machine M is being advanced into the seam the lead conveyor unit U follows along in the guide tracks 31.

Figure 6:
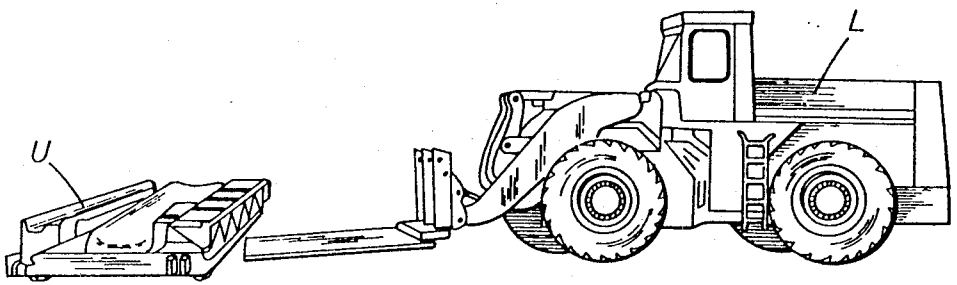
FIG. 6 is a partially perspective schematical view showing a front end loader preparing to lift a modular conveyor unit from the ground.
Figure 5:
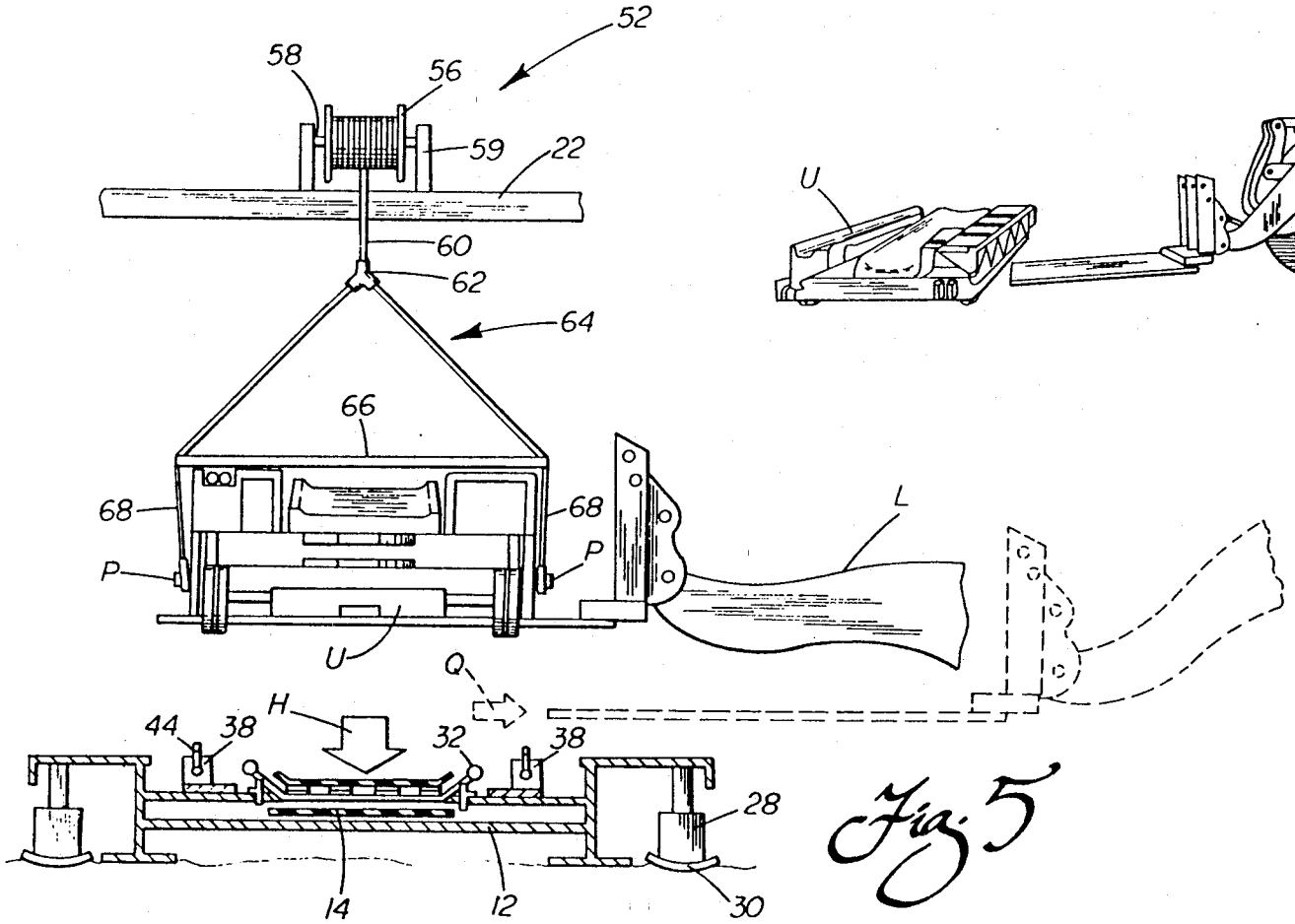
FIG. 5 is a schematical representation showing the mechanism adapted for positioning a conveyor unit on the launch vehicle.

As the mining machine M advances a front end loader L may be utilized to lift a modular conveyor unit U and hold it for connection to the hooks 68 of the conveyor lift mechanism 52 as shown in FIGS. 3*a* and 5. As shown in FIGS. 5 and 6, the conveyor unit U is held by the front end loader L in a position with the ends of the unit directly under the cross bars 66. The hooks 68 are then attached to the four pins P adjacent the corners of the conveyor unit U. The winch lines 60 are then taken-up slightly to remove all slack. The front end loader L is then disengaged from the new conveyor unit U (note action arrow Q) that is now suspended by the winch lines 60. As the mining machine M advances, the control lines of the new modular conveyor unit U held on the winch lines 60 are connected to the control lines of the last conveyor unit of the conveyor train T (in this instance, the lead conveyor unit). This initiates operation of the belt conveyor on the new conveyor unit U. Again, throughout this operation it should be realized that the mining of coal is continuously taking place.

Once the mining machine M is sufficiently advanced into the seam to provide clearance on the launch vehicle 10, the drive motor 54 is actuated so as to evenly pay-out the winch lines 60 and lower the new conveyor unit U until the ground engaging wheels W rest upon the guide tracks 31 (note action arrow H in FIG. 5). It should be appreciated that the wheels W straddle the launch vehicle conveyor 14 (see FIGS. 2*a* and 5). Next, the hooks 68 are manually disengaged from the pins P and the winch lines 60 are taken-up to the original raised position for subsequent receipt of the next conveyor unit U.

A pusher cylinder 88, mounted to the framework 12 of the launch vehicle 10 beneath the operator cab 18 is then activated to push (note action arrow X in FIG. 3*b*) the new conveyor unit U into engagement with the rear of the conveyor train T (again, in this instance into engagement with the lead conveyor unit directly behind the mining machine). As shown, the pusher cylinder 88 includes an extensible rod 89 having a bumper 90 at the distal end that engages the rear of the new conveyor unit U. This serves to drive the new conveyor unit U into engagement with the rear of the conveyor train T where it may be coupled thereto in a manner described above. Once the new conveyor unit U is coupled to the end of the conveyor train T, the pusher cylinder 88 is recycled to the fully retracted position shown in FIG. 3*a*.

It should also be appreciated that throughout the operation of adding a conveyor unit U to the conveyor train T, aggregate coal is being cut and conveyed continuously for recovery.

More particularly, as the first conveyor unit U is being positioned on the launch vehicle 10, aggregate coal cut from the seam S by the mining machine M is being passed by the flight conveyor F to the lead conveyor unit of the conveyor train T. From there the coal is delivered to each succeeding unit U of the conveyor train T until it is discharged by the end conveyor unit of the train onto the receiving conveyor 14 of the launch vehicle 10. The receiving conveyor 14 then conveys the aggregate coal under the new conveyor unit U, that is to be added to the train, to the discharge conveyor 20.

The discharge conveyor 20 conveys the coal C to a delivery location, such as the bed of a coal truck (not shown) for haulage to a stock pile or for further processing.

As the new conveyor unit U is positioned by the lift mechanism 52 onto the guide tracks 31 and advanced by the pusher cylinder 88 toward the rear of the conveyor train T, the receiving end of the new conveyor unit begins to intercept the coal C being discharged by the conveyor of the end unit of the conveyor train. As previously described, the conveyor of the new unit is already operating when this occurs. Accordingly, at interception the coal C is conveyed along the conveyor of the new conveyor unit to the discharge end where it is still delivered to the receiving conveyor 14 of the launch vehicle 10. From there the aggregate coal is conveyed to the delivery location as described above.

Once the new conveyor unit U is rigidly coupled to the rear conveyor unit of the train T the reciprocating drive assembly 34 may be operated to aid in advancing the mining machine M and conveyor train T into the coal seam S.

More particularly, as best shown in FIG. 3*b*, when the pushing cylinder 88 is fully extended to connect the conveyor unit U the lead pins P at each side of the conveyor unit U are in position to be engaged by the pusher arms 44 of the fully retracted rearward tandem drive cylinders 38. The rods 40 of the cylinders 38 are then extended synchronously and in tandem to aid in advancing the conveyor train T and mining machine M into the seam face S. The pushing force is applied through the arms 44 that are positioned to have an upright, leading section 47 for engaging a rearwardly facing portion of a pin P and a horizontally extending trailing section 49 that engages the base 46 to hold the upright section 47 firmly in position.

As the rearward drive cylinders 38 are extended, the forward tandem cylinders 36 are recycled from the fully extended position to the fully retracted position. Thus, while the rearward tandem cylinders 38 aid in advancing the conveyor train T and mining machine M by operation in the direction of action arrow Y, the forward tandem cylinders 36 are moving in the reverse direction and recycled as indicated by action arrow V.

It should be appreciated that the pusher arms 44 of the forward tandem cylinders 36 pivot down under the pins P on the sides of the conveyor units U as they move in the direction of action arrow V so as to allow passage. More specifically, as best shown in FIG. 2*c*, each pusher arm 44 is mounted on a pivot pin 48 in base 46. Accordingly, when the rear face engages a pin P, the pusher arm 44 is cammed downwardly and pivots as shown by the action arrow J to allow passage of the arm under the pin. After passing under the pin P, the arms 44 of the forward tandem cylinders 36 are manually returned to the upright, pin engaging and pushing position shown in FIG. 2*b*. This may be done, for example, by pushing downwardly on the trailing section 49 and pivoting the arms 44 about the pivot pin 48.

As the rearward tandem cylinders 38 approach their movement limit (see FIG. 3*a*), the already fully retracted forward tandem cylinders 36 are activated to begin extending the cylinder rods 40 in the direction of action arrow Z. As this is done, the arms 44 of the forward tandem cylinders 36 engage the intermediate pins P on the next-to-last conveyor unit U of the conveyor train T. Continued extension of the forward tandem drive cylinders 36 serves to continue to aid in the advance of the mining machine M and conveyor train T. As the forward tandem cylinders 36 are extended in the direction of action arrow Z and aid in the advance, the rearward tandem cylinders 38 are recycled and move in the opposite direction as shown by action arrow R. As already described above, when the arms 44 of the rearward tandem cylinders 38 come into engagement with a pin P, they are pivoted downwardly to allow passage under the pin. After passing under two pins P, the arms 44 of the rearward tandem cylinders 38 are manually returned to the upright, pin engaging and pushing position shown in FIG. 2*b* in the above-described manner.

As the forward tandem cylinder set 36 approaches its limit of movement, the already fully recycled rearward tandem cylinders 38 begin to extend the cylinder rods 40 until the arms 44 of the rearward cylinders 38 engage the next set of pins P at the rear of the conveyor unit U. The shuttling operation of the two tandem sets of cylinders 36, 38 then continues in the manner described for as many conveyor units U as are added to the conveyor train during the advance into the coal seam. Of course, as should be appreciated, the pusher arms 44 of each tandem cylinder set 36, 38 engage every other pin on the side of the conveyor units U. Further, the pins P must be properly positioned on the conveyor units U so as to have equal spacing between each pin corresponding to the spacings between and movement range of the tandem cylinder sets 36, 38. Additionally, it should be noted that throughout the operation of advancing the mining machine M and conveyor train T, coal is being conveyed without interruption.

Once the maximum desired mining depth is reached, the conveyor train T and mining machine M may be backed from the seam. This process is done a conveyor unit U at a time.

More particularly, the arms 44 of the pusher arm units 42 are disengaged from the cooperating pins P of the conveyor units U resting on the launch vehicle 10. The arms 44 are then pivoted over to the phantom line position shown in FIG. 2*b* (note action arrow K) so that the trailing sections 49 extend vertically and the leading sections 47 extend horizontally. Next the tandem drive cylinders 36, 38 are manipulated so as to bring one drive set of arms 44 into engagement with the sides of the pins P nearest the coal seam face S. The other set of arms 44 is driven to a fully recycled position. The drive assembly 34 is then utilized in conjunction with the crawler assemblies N of the mining machine M to back the conveyor train T and mining machine M from the seam.

More specifically, when the forward tandem cylinder set 36 is fully extended and engaging pins P at each side of a conveyor unit U, the cylinder rods 40 are retracted. This action serves to aid the mining machine in moving the conveyor train away from the seam face and back toward the operator cab 18. Of course, in accordance with the shuttling operation of the tandem cylinder sets, 36, 38, as the forward cylinder set 36 is being retracted, the rearward cylinder set 38 is being extended. During extension of the rearward cylinder set 38, the arms 44 are cammed under any pins P with which they come into contact without adversely effecting movement of the conveyor train.

As the forward conveyor set 36 approaches its limit of movement by becoming fully retracted, the rearward cylinder set 38 begins retracting. Accordingly, the arms 44 of the rearward cylinder set 38 are positioned to engage pins P on a conveyor unit U so as to provide assistance in withdrawing the conveyor train T and mining machine M from the coal seam. Hence, the trailing sections 49 are positioned to extend vertically with the leading sections 47 engaging the base 46. As this is done, the forward cylinders 36 are re-extended (recycled), once again, with the arms 44 of the forward units pivoting down beneath and passing under any pins P that they engage during the process. The arms 44 are then manually reset as already described to engage the pins P as required. This shuttling operation of the cylinder sets 36, 38 continues until a conveyor unit U reaches the rearmost end of the launch vehicle 10. At that point in time, the rearmost conveyor unit U is disconnected from the conveyor train T and a front end loader L is utilized to remove that disconnected conveyor unit from the launch vehicle 10.

The process of removing the conveyor units U of the conveyor train T continues in this manner until the lead conveyor unit and mining machine M are positioned once again on the guide tracks 31 of the launch vehicle 10. At that point in time the launch vehicle 10 is released from the anchoring system (e.g., anchoring cables may be disconnected from the launch vehicle and the anchoring pipes may be removed from the bench). The launch vehicle frame 12 is then raised from the bench B by means of the jacks 28. Heavy equipment such as a bulldozer is then utilized to push the launch vehicle 10 on the skids 30 to the next mining location. Alternatively, the launch vehicle 10 is equipped with auger skids for this purpose. If desired to aid in the movement of the launch vehicle 10, the extensible front end 72 may first be fully retracted. More specifically, the cylinders 80 are actuated so as to retract the extensible framework 74 until it is fully received within the main framework 12 of the launch vehicle 10.

Once positioned to continue mining, the launch vehicle framework 12 is again lowered by the jacks 28 until it engages with the bench B. The anchoring system is then reset, the extensible framework 74 is re-extended if desired, and mining operations proceed in the manner described above.

In summary, numerous benefits result from employing the concepts of the present invention. The launch vehicle 10 may be utilized in a system to provide continuous, uninterrupted cutting and conveying of coal from a seam face so as to maximize production. Advantageously, the cutting and conveying of the aggregate material continues even as additional modular conveyor units U are being added to the conveyor train T. Further, the launch vehicle 10 includes a drive assembly 34 that aids in selectively advancing or withdrawing the mining machine and the conveyor train into or from the coal seam. This is a major advantage in areas with soft bottom material such as fire clay. In fact, the launch vehicle 10 allows efficient mining of such areas which was not truly possible in the past. Further, since this is achieved without tearing up the mine floor, recovered product is not contaminated with bottom material.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the positioning unit 52 may be a hydraulic cylinder set rather than the winch system described. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A launch vehicle for a continuous mining system including modular conveyor units that may be connected together to form a conveyor train, comprising:

a main frame movably supporting a rear portion of said conveyor train;

conveying means attached to said main frame for conveying aggregate material received from said conveyor train to a delivery location;

means attached to said main frame for selectively advancing and withdrawing said conveyor train; and means for adding a modular conveyor unit to said conveyor train without interrupting the conveying of aggregate material by said conveyor train.

2. The launch vehicle set forth in claim 1, wherein said aggregate material conveying means is a belt conveyor.

3. The launch vehicle set forth in claim 1, wherein said means for selectively advancing and withdrawing said conveyor train includes means for engaging a modular conveyor unit of said conveyor train and means for driving said conveyor train through said engaging means.

4. The launch vehicle set forth in claim 3, wherein said engaging means includes a pusher arm unit for connecting said driving means to said modular conveyor unit of said conveyor train.

5. The launch vehicle set forth in claim 3, wherein said driving means includes two sets of tandem drive cylinders, each set having one drive cylinder on each side of said conveying means mounted to said main frame.

6. The launch vehicle set forth in claim 5, wherein said drive cylinders of said two sets of tandem drive cylinders mounted on each side of said conveying means are longitudinally aligned and spaced from one another.

7. The launch vehicle set forth in claim 1, wherein said means for adding a modular conveyor unit to said conveyor train includes means for pushing said modular conveyor unit into engagement with said conveyor train.

8. The launch vehicle set forth in claim 7, wherein said means for adding a modular conveyor unit to said conveyor train further includes positioning means selectively displaceable between a first position for holding a conveyor unit to be subsequently added to said conveyor train adjacent said conveyor train on said launch vehicle and a second position for placing said conveyor unit to be added to said conveyor train on said launch vehicle behind said conveyor train.

9. The launch vehicle set forth in claim 8, wherein said positioning means includes a power source, a pair of take-up reels driven by said power source, one line attached to each reel and a cross bar, including a pair of hooks for engaging said conveyor unit, mounted on a distal end of each line.

10. The launch vehicle set forth in claim 1, further including means for anchoring said launch vehicle to the ground.

11. The launch vehicle set forth in claim 1, further including extensible front end means comprising an extensible framework received in sliding engagement with said main frame and means for displacing said extensible framework between extended and retracted positions.

12. The launch vehicle set forth in claim 11, further including means for supporting and guiding modular conveyor units on said main frame above said aggregate material conveying means.

13. The launch vehicle set forth in claim 1, further including means for supporting and guiding modular conveyor units on said main frame above said aggregate material conveying means.

14. The launch vehicle set forth in claim 1, further including a discharge conveyor for feeding aggregate material to a delivery location.

15. The launch vehicle set forth in claim 1, further including means for selectively lifting said main frame above the ground and lowering said main frame into engagement with the ground.

16. The launch vehicle set forth in claim 15, including means for supporting said main frame when raised for movement along the ground.

17. The launch vehicle set forth in claim 16, wherein said supporting means is a series of skids spaced along said frame.

18. A launch vehicle for a continuous mining system including modular conveyor units that may be connected together to form a conveyor train, comprising:

a main frame movably supporting a rear portion of said conveyor train;

means attached to said main frame for selectively advancing and withdrawing said conveyor train; and receiving means attached to said main frame for continuously receiving aggregate material from said conveyor train as each said modular conveyor unit is added to said conveyor train.

19. The launch vehicle set forth in claim 18, further including means for conveying aggregate material received from said conveyor train mounted to said main frame.

20. A launch vehicle for a continuous mining system including modular conveyor units that may be connected together to form a conveyor train, comprising:

a main frame;

means for adding a modular conveyor unit to said conveyor train;

means for conveying aggregate material from said conveyor train to a delivery location;

means for selectively advancing and withdrawing said conveyor train; and extensible front end means selectively displaceable between a fully retracted position wherein said extensible front end means is fully received within said main frame and a fully extended position wherein said extensible front end means is extended in front of said main frame to support a portion of said conveyor train.

21. A launch vehicle for a continuous mining system including modular conveyor units that may be connected together to form a conveyor train; comprising:

a main frame;

means for conveying aggregate material from said conveyor train to a delivery location mounted on said main frame; and means for adding a modular conveyor unit to said conveyor train during cutting and conveying of aggregate material, said adding means including positioning means selectively displaceable between a first position for holding a modular conveyor unit to be subsequently added to said conveyor train adjacent said conveyor train and a second position for placing said conveyor unit to be added to said conveyor train on said launch vehicle behind said conveyor train;

said positioning means including a power source, a pair of take-up reels driven by said power source and mounted to said launch vehicle frame, one line attached to each take-up reel and means at a distal end of each line for engaging a conveyor unit.

22. The launch vehicle set forth in claim 21, wherein each said means for engaging a conveyor unit includes a support sling and yoke for attachment to said line and a cross bar and a pair of hook members for engaging said conveyor unit.

23. The launch vehicle set forth in claim 22, wherein said means for adding a modular conveyor unit to said conveyor train includes means for pushing said conveyor unit being added to said conveyor train into engagement with said conveyor train.

* * * * *